US005205557A

United States Patent [19]

Kuo

[11] Patent Number: 5,205,557

[45] Date of Patent: Apr. 27, 1993

[54] MAZY PUZZLE

[76] Inventor: Jewry Kuo, No. 339, Taya Rd., Taichung, Taiwan

[21] Appl. No.: 872,381

[22] Filed: Apr. 23, 1992

[51] Int. Cl.[5] ..... A63F 9/08

[52] U.S. Cl. ..... 273/153 S; 273/281

[58] Field of Search ..... 273/153 S, 153 R, 242, 273/281

[56] References Cited

U.S. PATENT DOCUMENTS

| | | | |
|---|---|---|---|
| 616,765 | 12/1898 | Brann | 273/153 R |
| 4,465,280 | 8/1984 | Dimitriu | 273/153 R |
| 4,470,601 | 9/1984 | Finn | 273/153 S |
| 4,759,547 | 7/1988 | Shin-Tao | 273/153 S |

FOREIGN PATENT DOCUMENTS

| | | | |
|---|---|---|---|
| 0653661 | 12/1962 | Canada | 273/153 R |
| 2359407 | 6/1975 | Fed. Rep. of Germany | 273/153 R |
| 0001946 | of 1900 | United Kingdom | 273/153 R |

*Primary Examiner*—V. Millin
*Assistant Examiner*—Steven B. Wong
*Attorney, Agent, or Firm*—Browdy and Neimark

[57] ABSTRACT

A mazy puzzle comprises mainly an upper housing, a lower housing, an intermediate plate, a maze plate, a movable piece, and maze blocks. The maze plate consists of a plurality of positioning frames, into each of which a maze block is inserted. The mazy pathways having therein obstacles which are located in the space surrounded by maze blocks and maze plate. The movable piece has a lower portion insertable into the pathway via an inlet and an upper portion extending beyond the surface of maze blocks. The movable piece is moved by the player along the mazy pathways to a prescribed destination without interference only when the movable piece is guided successfully by the player to avoid hitting the concealed obstacles set up along the pathways.

4 Claims, 4 Drawing Sheets

MAZY PUZZLE

BACKGROUND OF THE INVENTION

The present invention relates to a mazy puzzle, which is a toy designed creatively, interestingly and educationally for exercising one's mind over the solution of a problem and for testing one's cleverness, skill, or ingenuity.

The mazy puzzle refers to a game provided with a confusing, intricate network of winding pathways, with one or more blind alleys. Such puzzle is generally printed on paper and played by people for amusement and intellectual exercise. In general, a player uses a pencil or pen to trace the pathways of the puzzle printed on the paper. As a result, the used puzzle can not be played again by other people. By and large, such conventional puzzle printed on the paper is so monotonous and boring that people, especially youngsters, get tired of playing it easily.

There is recently a new kind of mazy toy made of plastic material and provided with the upright pathways of labyrinth, in which a small ball travels. A player controls the traveling direction of the rolling ball so as to guide the ball to move on along the correct pathways to reach the prescribed destination. Such plastic mazy toy described above is defective in design in that it fails to provide a player with a demanding task calling for the player's special effort or dedication, in view of the fact that its pathways can be readily perceived by the player, who becomes weary of the game easily. Such dull and tiresome toy often fails to draw the attention of people in general and youngsters in particular to take interest in playing it.

SUMMARY OF THE INVENTION

It is, therefore, the primary objective of the present invention to provide a mazy puzzle with a variety of movable pieces and the upright pathways obstructed by the concealed obstacles. The movable pieces are capable of moving freely along the correct pathways, which are marked by frequent and intriguing changes and are often difficult to be perceived by the player.

It is another objective of the present invention to provide a mazy puzzle with various emblems, characters or symbols, which can be arranged in conjunction with the mazy pathways and which stand for or suggest some lively stories so as to achiece the dual purposes of amusement and education.

It is still another objective of the present invention to provide a mazy puzzle with various pathways obstructed by obstacles capable of triggering a voice-reproducing means so as to make it a fun toy to play with.

In keeping with the principles of the present invention, the foregoing objectives of the present invention are accomplished by a mazy puzzle, which has a receiving space of a predetermined size located between an upper housing and a lower housing thereof and provided with a maze element comprising at least a maze plate and a plurality of maze blocks. Located at predetermined locations on the maze plate are a plurality of positioning frames. There are mazy pathways of a width spaced apart one another and located in the space surrounded by maze blocks, maze plate and upper housing, with each of mazy pathways consisting of a plurality of obstacles. In addition, the mazy puzzle of the present invention comprises at least a movable piece, which has a lower portion capable of entering the mazy pathway via a predetermined location on the maze plate and which has an upper portion extending beyond the maze block. The movable piece can be actuated by the player to move along the mazy pathways to a prescribed destination. Such deed is achieved by the player, who must exercise a great deal of good judgment and caution so as to control the movement of the movable piece along the mazy pathways in such a manner that the movable piece on the move does not hit any obstacle set up along the pathways.

The mazy puzzle of the present invention further comprises an intermediate plate and two thin-film circuit boards, which are located between the maze plate and the lower housing. The intermediate plate has a protruded portion located correspondingly to the retaining base of the maze plate so as to keep the two thin-film circuit boards apart. When the movable piece hits an obstacle, these two thin circuit boards make contact with each other so as to trigger the voice-reproducing means to produce the sound of speech or music.

The mazy puzzle of the present invention is further characterized in that its movable piece is composed of an upper portion representing a shape or a symbol of special significance, and of a lower portion having an obstruction dent located at a position specific to a given pathway through which the movable piece is permitted to pass freely.

The foregoing objectives and features of the present invention will be better understood by studying the following detailed description of preferred embodiments of the present invention, in conjunction with the drawings provided herewith.

DETAILED DESCRIPTION OF THE PREFERRED EMBODIMENTS

Figure 1:
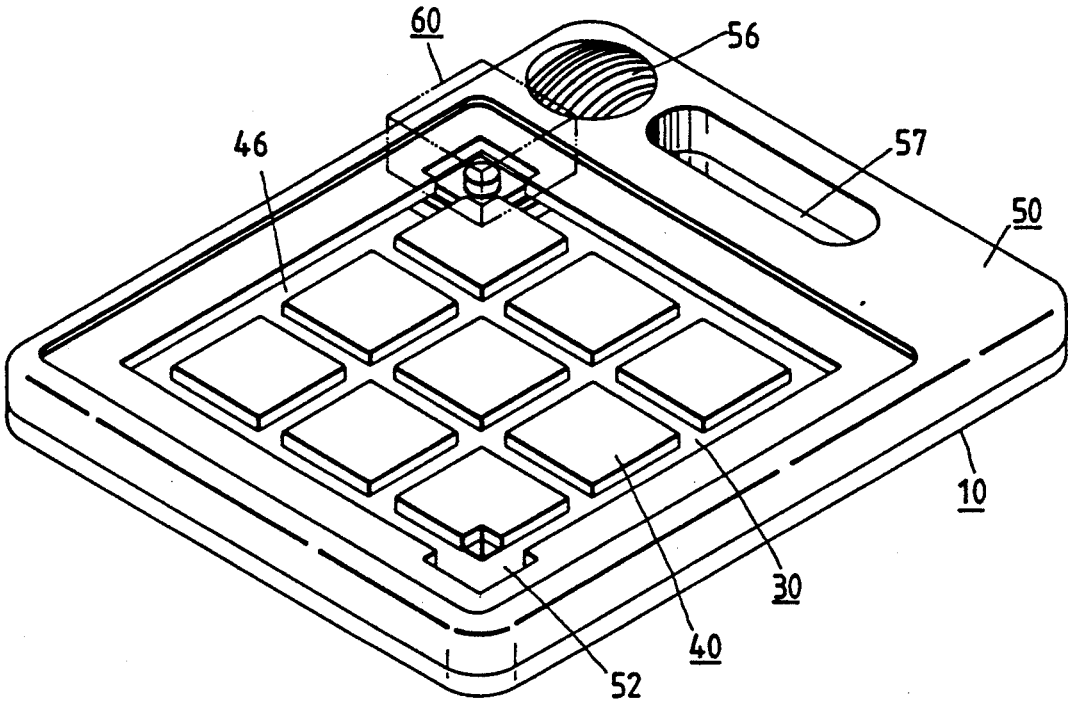
FIG. 1 shows a three-dimensional view of a first preferred embodiment of the present invention.
Figure 2:
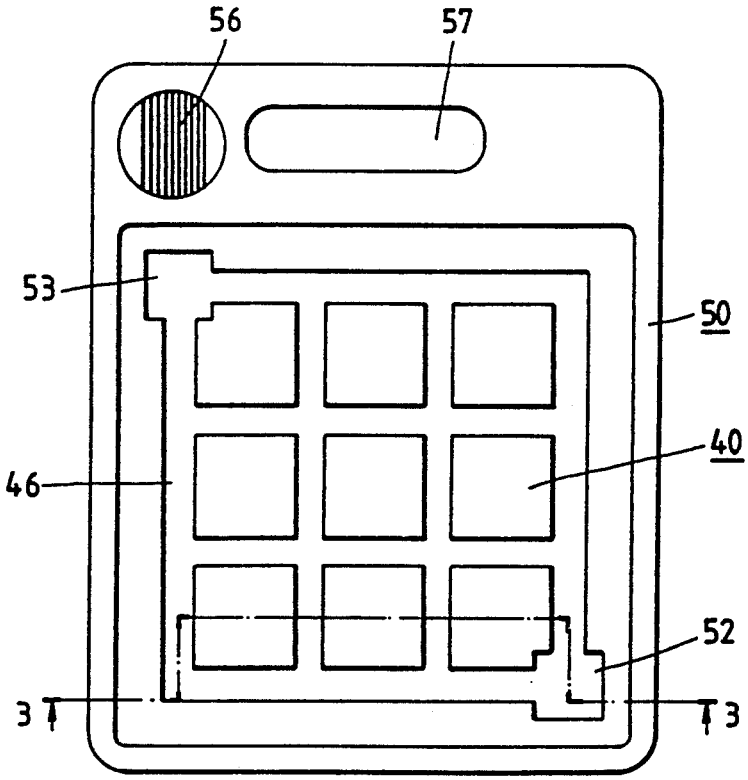
FIG. 2 shows a plan top view of the first preferred embodiment of the present invention as shown in FIG. 1.
Figure 3:
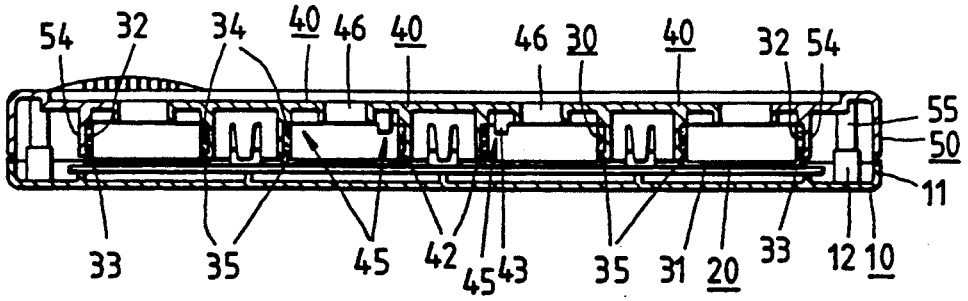
FIG. 3 shows a sectional view of a portion taken along the line 3—3 as shown in FIG. 2.

Referring to FIGS. 1–7, a mazy puzzle embodied in the present invention is shown comprising a lower housing 10, an intermediate plate 20, a maze plate 30, a plurality of maze blocks 40, an upper housing 50, and several movable pieces 60.

Figure 4:
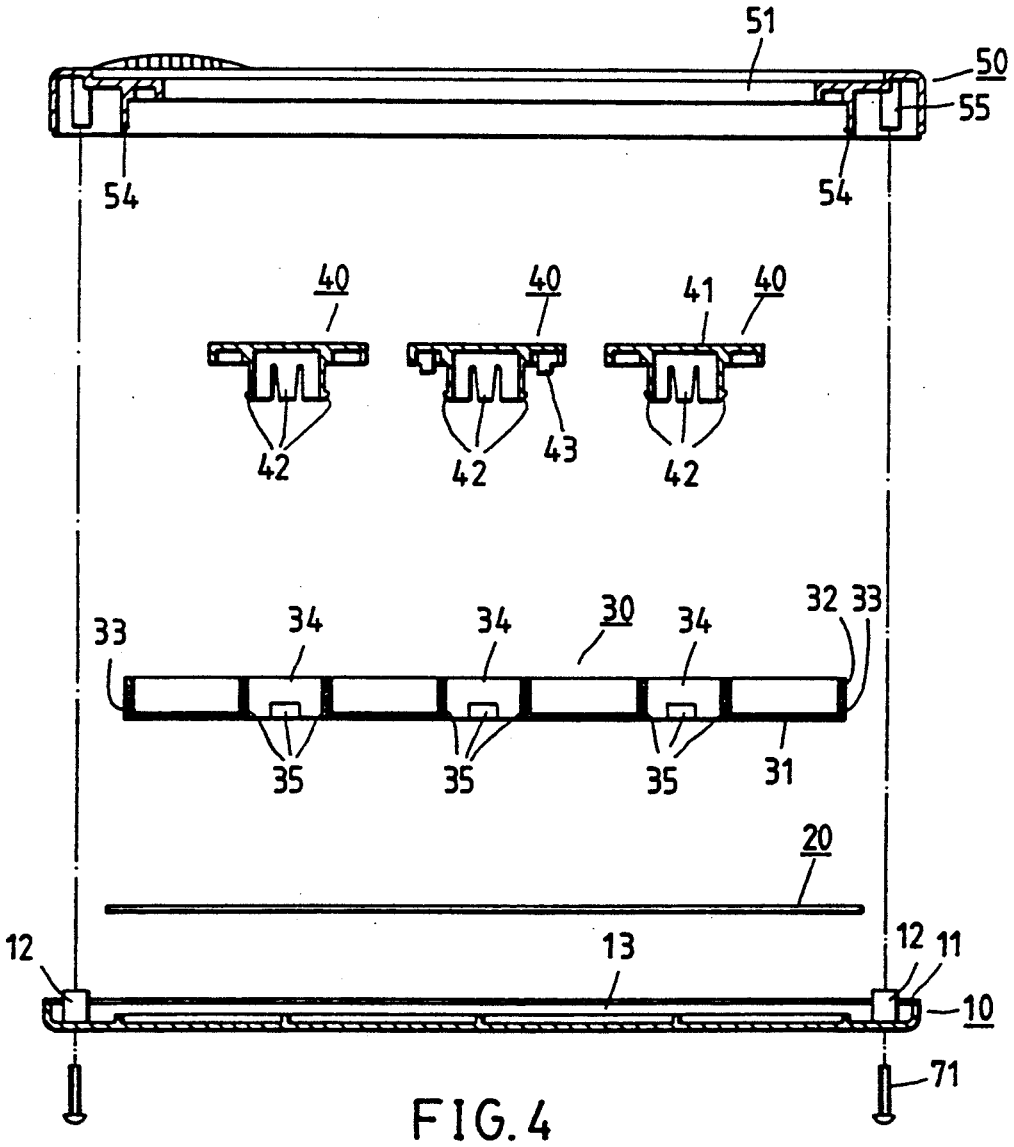
FIG. 4 shows an exploded view of the portion as shown in FIG. 3.
Figure 5:
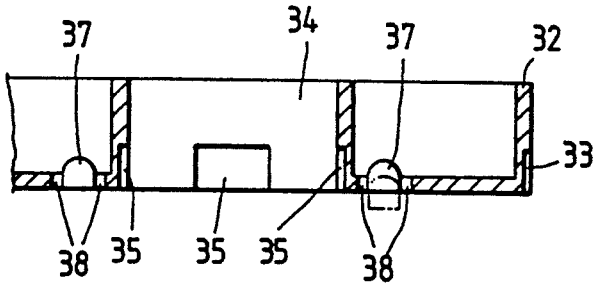
FIG. 5 shows an enlarged view of a maze plate as shown in FIG. 4 modified for use with a second embodiment of the invention.
Figure 8:
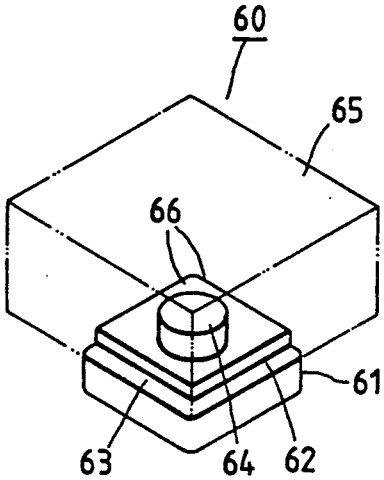
FIG. 8 shows a three-dimensional schematic view of a movable piece embodied in the present invention.
Figure 6:
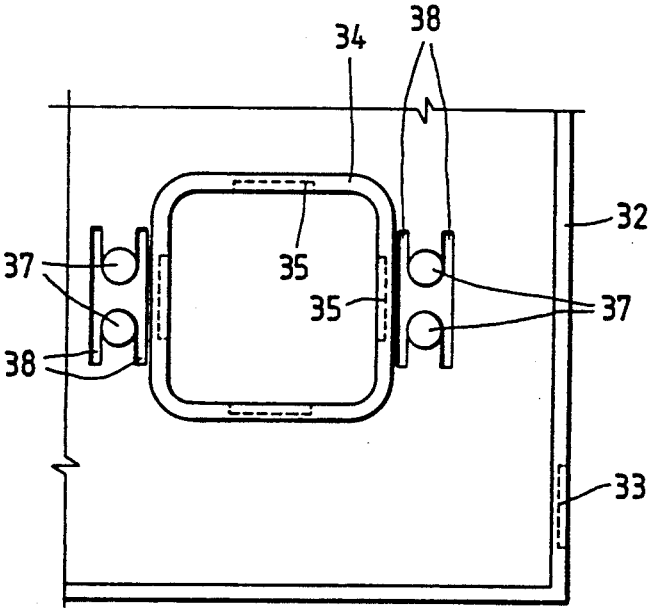
FIG. 6 shows a plan top view of a positioning frame as shown in FIG. 5.
Figure 7:
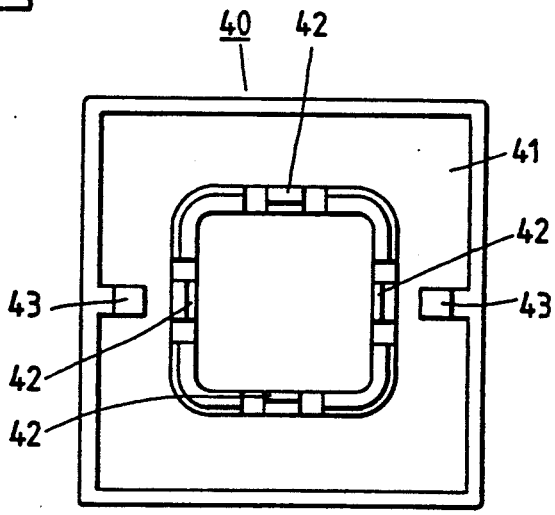
FIG. 7 shows a plan bottom view of a maze block as shown in FIG. 4.
Figure 9:
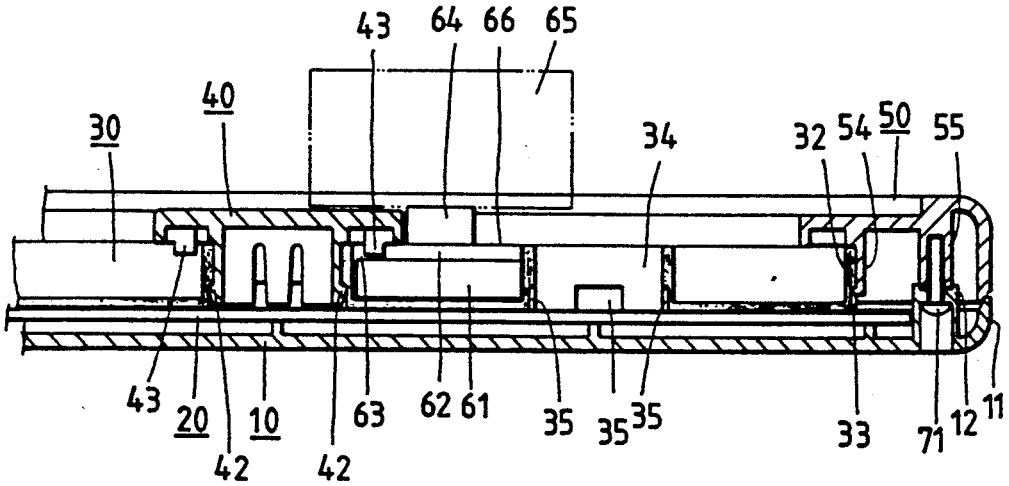
FIG. 9 is a partial sectional view showing the movable piece on the move in the mazy puzzle of the present invention.

The lower housing 10 of plastic material has an annular frame 11, several round holes 12, and a recessed portion 13, as shown in FIG. 4.

The intermediate plate 20 is disposed in the recessed portion 13 of the lower housing 10 so as to give a support to the maze plate 30.

The maze plate 30 is made of plastic material by means of injection molding and is composed of a bottom plate 31 provided with a side frame 32 having several hook holes 33. According to the first preferred embodiment of the present invention, the bottom plate 31 is provided with 3×3 positioning frames 34 of tetragonal construction, with each of four sides provided with a hook hole 35.

The maze blocks 40 are arranged in such a manner that they correspond to the positioning frames 34. Each of 3×3 maze blocks 40 has a face plate 41 with a flat top and with a bottom provided with four retaining hooks 42 engageable with the hook holes 35 of the positioning frames 34. In addition, each of the maze blocks 40 is provided at the bottom thereof with at least an obstacle 43 extending outwardly. A variety of mazy pathways can be constructed on the maze plate 30 by setting up two obstacles 43 spaced apart by 180 degrees at the bottom of the maze block 40. There are a plurality of obstacle pathways 45 and surface pathways 46 between the maze block 40 and the maze plate 30.

The upper housing 50 of plastic material is arranged correspondingly to the lower housing 10 and is provided at the center thereof with a rectangular opening 51 for use in displaying the surface pathways 46. Located at the two opposite angles of the rectangular opening 51 are an inlet 52 and an outlet 53. The bottom of the upper housing 50 has several retaining hooks 54 engageable with the hook holes 33 of the side frame 32 of the maze plate 30 so that the maze plate 30 and the upper housing 50 are held securely in place. The upper housing 50 is further provided with several threaded columns 55, each of which is located correspondingly to each round hole 12 of the lower housing 10 to receive therein a screw 71 serving to fasten together the upper housing 50 and the lower housing 10. In addition, the upper housing 50 is provided with a speaker hole 56 and a grip hole 57 for carrying the mazy puzzle of the present invention.

The movable piece 60 consists of upper portion and lower portion which is in fact a sliding block 61 of rectangular construction capable of sliding in the obstacle pathways 45 and having two recess cuts 62 and 63 located respectively at upper portions of two sides thereof and further having a circular projection 64 located at the center thereof and provided with a diameter slightly smaller than the width of the surface pathway 46. The movable piece body 65 may be constructed in the forms of man, animal, transportation means such as a car, and the like. The bottom of the movable piece body 65 has a connection hole dimensioned to engage securely the circular projection 64 of the sliding block 61.

In the process of combining the components described above into a mazy puzzle of the present invention, the maze plate 30 is fastened to the bottom of the upper housing by means of retaining hooks 54 and hook holes 33. The intermediate plate 20 is disposed securely in place between upper and lower housings 10 and 50 and the maze plate 30 by means of a plurality of screws 71, each of which passes through the round hole 12 to engage the threaded column 55. Thereafter, each of the maze blocks 40 is inserted into the positioning frame 34 of the maze plate 30 in such a manner that the former is secured to the latter by means of the retaining hook 42 and the hook hole 35.

In operating the mazy puzzle of the present invention, the sliding block 61 of the movable piece 60 is placed in the inlet 52 so that the sliding block 61 is located right in the obstacle pathway 45 and that the circular projection 64 is positioned in the surface pathway 46. The sliding block 61 is permitted to pass without interference under the maze block 40 wherever the obstacle pathway 45 is free from an obstacle 43. However, if an obstacle 43 is present under the maze block 40, the sliding block 61 is permitted to pass therethrough only via its recess cuts 62 and 63. In other words, when the portions other than the recess cuts 62 and 63 of the sliding block 61 hit the obstacle 43, the movable piece 60 can not pass through and must try other pathways. Furthermore, the movable piece 60 on the move can be retrieved only at the destination outlet 53. The obstacle 43 is concealed under the maze block 40 and can not be therefore seen by the player. In addition, the movable pieces 60 vary in the positions of recess cuts 62 and 63 thereof. As a result, each movable piece 60 is permitted to pass through a specific pathway.

Figure 10:
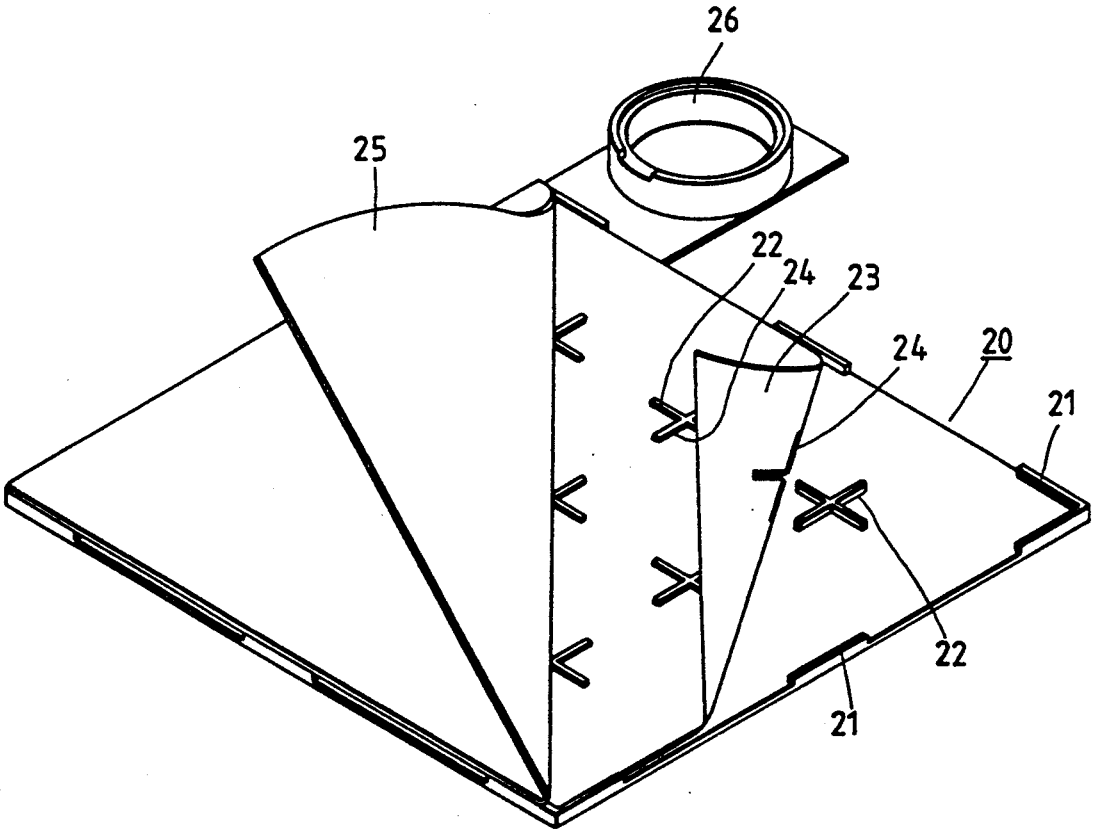
FIG. 10 is a partial exploded view of an intermediate plate embodied in a second preferred embodiment of the present invention.

As shown in FIG. 10, the second preferred embodiment of the present invention is shown comprising an intermediate plate 20 having a plurality of side ribs 21 located at its edges and having 3×3 cross ribs 22 located on its interior corresponding to each maze block 40 and further having a speaker mount 26. A first thin conductive piece 23 is provided with a plurality of cross holes 24 located correspondingly to the cross ribs 22 and has a size slightly smaller than that of the intermediate plate 20 in such a way that it fits into the intermediate plate 20 without obstructing the side ribs 21. A second thin conductive piece 25 is disposed on the intermediate plate 20 in such manners that it covers the side ribs 21 and the cross ribs 22 and that it is spaced apart from the first conductive piece 23. The intermediate plate 20, along with the first and the second conductive pieces 23 and 25, is arranged under the maze plate 30, with first and second conductive pieces 23 and 25 remaining apart. Now referring to FIGS. 5 and 6, the maze plate 30 is furnished with elastic projections 37 located correspondingly to the obstacles 43 and made integrally with the maze plate 30, along with the two side slots 38 adjacent to elastic projections 37. When sliding block 61 of the movable piece 60 hits an obstacle 43, the movable piece 60 also simultaneously hits the elastic projections 37, which are subsequently forced to move downward to cause the second conductive piece 25 to make contact with the first conductive piece 23. As a result, the sound reproducing means is triggered to produce a musical note or a simple tune.

The embodiments of the present invention described above are to be considered in all respects as merely illustrative and not restrictive. Accordingly, the present invention may be embodied in other specific forms without deviating from the spirit thereof. For example, the maze block 40 may be furnished with certain characters or figures, in cooperation with the form of the piece body 65 of the movable piece 60, so as to depict certain interesting venture stories that are liked by the children at large. In addition, the shape of the maze block 40 may be polygonal other than rectangular as embodied in the present invention. Such modification permits a greater variation of the pathways. Furthermore, the number of the maze blocks 40 may be increased to make the mazy puzzle of the present invention more complex and intriguing. The complexity of the puzzle may be adjusted appropriately by increasing or decreasing the number of recess cut 62 of the movable piece 60. Therefore, the present invention is to be limited only by the scope of the hereinafter appended claims.

What I claim is:

1. A mazy puzzle comprising an upper housing, a lower housing, and an opening in communication with a receiving space formed between said upper housing and said lower housing; wherein said puzzle is provided with a maze plate disposed between said upper housing and said lower housing, said maze plate having thereon a plurality of maze blocks of polygonal construction to form therebetween surface pathways having equal width and communicating with one another, each of said maze blocks further comprising a face plate, which forms an obstacle pathway wider than said surface pathway in spaced relation with said maze plate, at least one said face plate of said maze blocks having an obstacle extending downwardly into said obstacle pathway; wherein said puzzle is provided with at least one movable piece having a lower portion serving as a sliding block capable of sliding in said obstacle pathway and having at least one recess cut permitting said movable piece to pass through said obstacle pathway, said movable piece further comprising an upper portion of any shape serving as a movable piece body, said lower portion being integral to said upper portion; and wherein said puzzle is provided with at least an inlet located between said maze blocks and said lower housing such that said inlet is in communication with said surface pathway so that said inlet permits said sliding block of said movable piece to be placed thereinto, wherein said maze plate is a flat plate having around its edges a side frame having equal height throughout and having a plurality of hook holes engageable with retaining hooks of said upper housing.

2. The mazy puzzle of claim 1 wherein said maze plate has a plurality of positioning frames, each of which has a plurality of hook holes engageable with retaining hooks of said face plate of said maze block.

3. The mazy puzzle of claim 1 wherein said lower portion is of rectangular construction and said at least one recess cut is located on an upper portion of said lower portion, said lower portion having thereon a circular projection capable of passing through said surface pathway and joining with said movable piece body of said upper portion.

4. The mazy puzzle of claim 2 wherein an intermediate plate has a plurality of ribs, a first thin conductive piece having rib holes located correspondingly to said ribs engaged on said intermediate plate, and a second thin conductive piece supported on said plurality of ribs and arranged over said first thin conductive piece in spaced relationship so that it is pressed down to make contact with said first thin conductive piece when said movable piece hits said obstacle.

* * * * *